US006383711B1

(12) United States Patent
Winkel et al.

(10) Patent No.: US 6,383,711 B1
(45) Date of Patent: May 7, 2002

(54) HIGH CONTRAST PHOTOGRAPHIC SILVER HALIDE MATERIAL

(75) Inventors: Jurjen F. Winkel, Hemel Hempstead; Michael B. Ledger, Northwood, both of (GB)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 09/622,763

(22) PCT Filed: Dec. 20, 1999

(86) PCT No.: PCT/GB99/04320

§ 371 Date: Aug. 21, 2000

§ 102(e) Date: Aug. 21, 2000

(87) PCT Pub. No.: WO00/38008

PCT Pub. Date: Jun. 29, 2000

(30) Foreign Application Priority Data

Dec. 19, 1998 (GB) ..... 9827978

(51) Int. Cl.[7] ..... G03C 1/06

(52) U.S. Cl. ..... 430/264; 430/567; 430/598; 430/564; 430/607; 430/613

(58) Field of Search ..... 430/264, 567, 430/598, 564, 607, 613

(56) References Cited

U.S. PATENT DOCUMENTS

| | | | | |
|---|---|---|---|---|
| 4,030,925 A | | 6/1977 | Leone et al. | |
| 4,031,127 A | | 6/1977 | Leone et al. | |
| 4,269,929 A | | 5/1981 | Nothnagle | |
| 4,278,748 A | | 7/1981 | Sidhu et al. | |
| 4,323,643 A | | 4/1982 | Mifune et al. | |
| RE32,097 E | * | 3/1986 | Silverman et al. | 430/567 |
| 4,668,605 A | | 5/1987 | Okutsu et al. | |
| 4,740,452 A | | 4/1988 | Okutsu et al. | |
| 5,316,889 A | | 5/1994 | Sakai | |

FOREIGN PATENT DOCUMENTS

| | | |
|---|---|---|
| EP | 208 514 | 1/1987 |
| EP | 333 435 | 9/1989 |
| EP | 531 014 | 3/1993 |
| EP | 682 288 A1 * | 11/1995 |

* cited by examiner

*Primary Examiner*—Geraldine Letscher
(74) *Attorney, Agent, or Firm*—Andrew J. Anderson

(57) ABSTRACT

A high contrast photographic material comprises a support bearing a silver halide emulsion layer, containing in the emulsion layer or in an adjacent hydrophilic layer, a hydrazide nucleating agent characterized in that the emulsion layer contains silver halide grains of octahedral character which are spectrally sensitized and silver halide grains which are not octahedral in character eg cubic.

Preferably only the grains which are octahedral in character are spectrally sensitized.

Preferably the emulsion layer or an adjacent hydrophilic colloid layer contains a booster compound eg an amine rendering the material developable in a developer solution having a pH below 11.

Preferably both types of grain are chemically sensitized. The use of tabular grains as causer emulsions enhances the absorption characteristics of the dyes so that as well as providing high photographic sensitivity the dye peaks are broadened.

20 Claims, 2 Drawing Sheets

HIGH CONTRAST PHOTOGRAPHIC SILVER HALIDE MATERIAL

FIELD OF THE INVENTION

This invention relates to high contrast silver halide materials and particularly to those of the graphic arts type.

BACKGROUND OF THE INVENTION

For many years the very high contrast photographic images needed in the graphic arts and printing industries were obtained by developing a "lith" emulsion (usually high in silver chloride content) in a hydroquinone, low sulphite, "lith" developer by the process known as infectious development. However, such low sulphite developers are inherently unstable and are particularly inappropriate for machine processing.

More recently, emulsions containing hydrazine nucleating agents have been used and processed in a high pH (about pH 11.5) developer with conventional amounts of sulphite, hydroquinone and possible metol or a pyrazolidone. While such a process is better than the low sulphite lith process, the developer still has less sulphite than is optimal and a high pH requirement for it to function correctly. Such a solution is not as stable as is desirable. Additionally high pH solutions are environmentally undesirable because of the care needed in handling and disposing of the effluent.

EP-A-0 531014 claims high contrast materials sensitive to more than one spectral region comprising one layer of emulsion sensitive to one region and another emulsion layer sensitive to another region. Each spectral sensitivity requires its own emulsion layer. In a comparative test (page 6 lines 9 to 19) a blend of differently dye sensitised emulsions was used as the sole emulsion layer. This material showed loss of speed, especially if one of the spectral regions is in the infrared. The explanation for this appears to be that the sensitising dyes are being desorbed from their silver halide grain hosts.

EP-A-0 208514 claims high contrast materials containing a hydrazide wherein there are two distinct populations of grains differing in grain volume. In the comparative examples (outside the scope of the invention claimed) emulsion blending is described. Some of the blends are dye sensitised. However the blending takes place before the addition of any sensitising dye so that the blended emulsions described have grains which are either all dye sensitised or all not dye sensitised. Blends of sensitised and unsensitised grains are not mentioned.

A further improvement in the area of high contrast materials is the introduction of a lower pH process (below pH 11) using hydrazides active at this low pH together with the use of a contrast booster compound, for example, one of the boosters described in U.S. Pat. No. 5,316,889 or an amine booster as described in U.S. Pat. Nos. 4,269,929; 4,668,605; and 4,470,452. The hydrazides proposed for use in such materials are described for example in U.S. Pat. Nos. 4,278,748; 4,031,127; 4,030,925 and 4,323,643 and in European Patent 0,333,435.

In most photographic materials the type and size of the silver halide grain determines the speed of the material while also affecting the covering power of the silver image formed therefrom. In general smaller sized grains provide higher density and covering power than larger ones. In some materials therefore there has to be a balance struck between speed and covering power in high contrast materials another balance between vigorous development and pepper fog (which occurs if development is too vigorous) needs to be achieved.

EP-A-0 682 288 describes high contrast photographic materials containing a silver halide emulsion layer and containing in the emulsion layer or in an adjacent hydrophilic colloid layer a hydrazide nucleating agent wherein the emulsion contains silver halide grains which are spectrally sensitised and silver halide grains which are not spectrally sensitised the sensitising dye(s) being chosen so that it does (they do) not become desorbed from the spectrally sensitised grains. This is said to provide savings in sensitising dye and improvements in ease of manufacture while retaining desirable density, low Dmin, high covering power and avoidance of pepper fog.

PROBLEM TO BE SOLVED BY THE INVENTION

The inventors of the present invention have found that grains with octahedral character do not nucleate efficiently in current nucleated graphic arts developers eg Kodak registered Trade Mark)RA 2000 chemistry. This implies that films containing only 111 tabular emulsions do not nucleate efficiently. On the other hand tabular emulsions would be desirable due to their inherent potential for high speed for a given grain volume. A solution to this problem has now been invented by using a dual emulsion system in which the emulsion grains of octahedral character, or more specifically 111 tabular character, are applied as a coating in conjunction with a non octahedral emulsion.

SUMMARY OF THE INVENTION

According to the present invention there is provided a negative-working high contrast pbotographic material comprising a support bearing a silver halide emulsion layer, containing in the emulsion layer or in an adjacent hydrophilic collide layer, a hydrazide nucleating agent characterized in that the emulsion layer contains silver halide grains of octahedral character which are spectrally sensitised and silver halide grains which are not octahedral in character.

ADVANTAGEOUS EFFECT OF THE INVENTION

The use of tabular grains as causer emulsions enhances the absorption characteristics of the dyes used so that as well as providing high photographic sensitivity, the dye peaks are broadened which is very usefull for films designed to cater for exposure devices of differing wavelengths.

BRIEF DESCRIPTION OF THE DRAWINGS

In the accompanying drawings

DETAILED DESCRIPTION OF THE INVENTION

Figure 1:
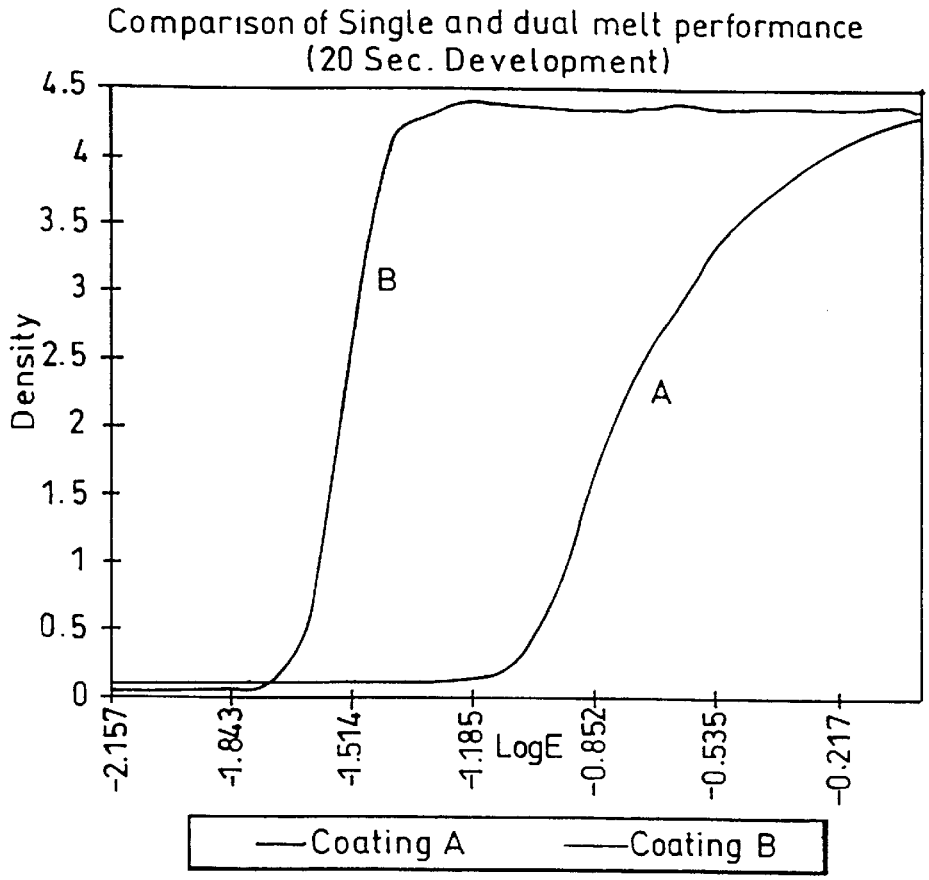
FIGS. 1 to 4 are graphs representing the results from Examples 1 and 2.

The term octahedral character refers to grains which are primarily bounded by crystallographic faces possessing 111 character and includes for example octahedral and 111 tabular grains.

The term not octahedral in character refers to grains which are not primarily bounded by crystallograohic faces possessing 111 character and includes for example cubic grains and 100 tabular grains.

Preferably the spectrally sensitised octahedral grains comprise from 5 to 50% of the total, more preferably from 20 to 30% molar of the total amount of silver. In a preferred form of the invention only the grains of octahedral character are spectrally sensitised.

The sensitising dye will be chosen so that it does (they do) not become desorbed from the spectrally sensitised grains.

The preferred photographic material contains both a hydrazide nucleating agent and a booster compound in the emulsion layer or an adjacent hydrophilic colloid layer, enabling it to be processed in a developer having a pH below 11 eg from 10 to 11.

The emulsion layer comprises two or more emulsion grain types. For example, more than one type of latent image-forming grain may be present. Grains sensitive to different regions of the spectrum may thus be used providing a material suitable for more than one exposing radiation type.

When there are grains present which are sensitised to distinct wavelength ranges and exposure is to a source of limited wavelength, some of the sensitised grains will not respond to this wavelength and are thus non-latent image forming grains under these conditions of use.

All the emulsion grains are preferably chemically sensitised for example with both sulphur and gold.

The latent image forming grains can be bromoiodide, chlorobromoiodide, bromide chlorobromide chloroiodide or chloride. They should preferably be spectrally sensitised.

The non latent image forming grains can be bromoiodide, chloroiodide, chlorobromoiodide, bromide, chlorobromide, or chloride.

Both types of grain may also contain dopants as more fully described below.

Preferably the silver halide grains are doped with one or more Group VIII metal at levels in the range $10^{-9}$ to $10^{-3}$, preferably $10^{-7}$ to $10^{-4}$, mole metal per mole of silver. The preferred Group VIII metals are Rhodium and/or Iridium.

The emulsions employed and the addenda added thereto, the binders, supports, etc. may be as described in Research Disclosure Item 308119, December 1989 published by Kenneth Mason Publications, Emsworth, Hants, United Kingdom. The hydrophilic colloid may be gelatin or a gelatin derivative, polyvinylpyrrolidone or casein and may contain a polymer. Suitable hydrophilic colloids and vinyl polymers and copolymers are described in Section IX of Research Disclosure Item 308119, December 1989 published by Kenneth Mason Publications, Emsworth, Hants, United Kingdom. Gelatin is the preferred hydrophilic colloid.

The present photographic materials may also contain a supercoat hydrophilic colloid layer which may also contain a vinyl polymer or copolymer located as the last layer of the coating (furthest from the support). It may contain some form of matting agent. The vinyl polymer or copolymer is preferably an acrylic polymer and preferably contains units derived from one or more alkyl or substituted alkyl acrylates or methacrylates, alkyl or substituted alkyl acrylamides or acrylates or acrylamides containing a sulphonic acid group.

Suitable hydrophilic binders and vinyl polymers and copolymers are described in Section IX of Research Disclosure Item 308119, December 1989 published by Kenneth Mason Publications, Emsworth, Hants, United Kingdom.

The present emulsion layers are preferably formed by dye sensitising emulsions with a single dye and then combining the differently spectrally sensitised emulsions together with any un-spectrally sensitised emulsion being used. The blending can be done immediately before coating but this is not necessary as the present blended emulsions are stable for at least 20 minutes at coating temperatures.

Any hydrazine compound may be used that functions as a nucleator and is preferably capable of providing, with a booster, a high contrast image on development at a pH below 11.

The hydrazine compound is incorporated in the photographic element, for example, it can be incorporated in a silver halide emulsion layer. Alternatively, the hydrazine compound can be present in a hydrophilic colloid layer of the photographic element, preferably a hydrophilic colloid layer which is coated to be adjacent to the emulsion layer in which the effects of the hydrazine compound are desired. It can, of course, be present in the photographic element distributed between or among emulsion and hydrophilic colloid layers, such as undercoating layers, interlayers and overcoating layers.

Suitable hydrazine compounds are disclosed in our copending European Patent Application No 99204096.4.

Other suitable hydrazine compounds may have the formula:

R†–NHNHCHO wherein R† is a phenyl nucleus having a Hammett sigma value-derived electron withdrawing characteristic of less than +0.30.

In the above formula, R† can take the form of a phenyl nucleus which is either electron donating (electropositive) or electron withdrawing (electronegative); however, phenyl nuclei which are highly electron withdrawing produce inferior nucleating agents. The electron withdrawing or electron donating characteristic of a specific phenyl nucleus can be assessed by reference to Hammett sigma values.

Preferred phenyl group substituents are those which are not electron withdrawing.

For example, the phenyl groups can be substituted with straight or branched chain alkyl groups (e.g., methyl, ethyl, n-propyl, isopropyl, n-butyl, isobutyl, n-hexyl, n-octyl, tert-octyl, n-decyl, n-dodecyl and similar groups). The phenyl groups can be substituted with alkoxy groups wherein the alkyl moieties thereof can be chosen from among the alkyl groups described above.

The phenyl groups can also be substituted with acylamino groups. Illustrative acylamino groups include acetylamino, propanoylamino, butanoylamino, octanoylamino, benzoylamino, and similar groups.

In one particularly preferred form the alkyl, alkoxy and/or acylamino groups are in turn substituted with a conventional photographic ballast, such as the ballasting moieties of incorporated couplers and other immobile photographic emulsion addenda. The ballast groups typically contain at least eight carbon atoms and can be selected from both aliphatic and aromatic relatively unreactive groups, such as alky, alkoxy, phenyl, alkylphenyl, phenoxy, alkylphenoxy and similar groups. The alkyl and alkoxy groups, including ballasting groups, if any, preferably contain from 1 to 20 carbon atoms, and the acylamino groups, including ballasting groups, if any, preferably contain from 2 to 21 carbon atoms.

Generally, up to about 30 or more carbon atoms in these groups are contemplated in their ballasted form. Methoxyphenyl, tolyl (e.g., p-tolyl and m-tolyl) and ballasted butyramidophenyl nuclei are specifically preferred.

Examples of the specifically preferred hydrazine compounds are the following:

1-Formyl-2-(4-[2-(2,4-di-ter-pentyl-phenoxy)-butyramido] phenyl)hydrazine,

1-Formyl-2-phenylhydrazine,

1-Formyl-2-(4-methoxylphenyl)hydrazine,

1-Formyl-2-(4-chlorophenyl)hydrazine,

1-Formyl-2-(4-fluorophenyl)hydrazine,

1-Formyl-2-(2-chlorophenyl)hydrazine, and
1-Formyl-2-(p-tolyl)hydrazine.

The hydrazine may also comprise an adsorption promoting moiety. Hydrazides of this type contain an unsubstituted or mono-substituted divalent hydrazo moiety and an acyl moiety. The adsorption promoting moiety can be chosen from among those known to promote adsorption of photographic addenda to silver halide grain surfaces. Typically, such moieties contain a sulphur or nitrogen atom capable of complexing with silver or otherwise exhibiting an affinity for the silver halide grain surface. Examples of preferred adsorption promoting moieties include thioureas, heterocyclic thioamides and triazoles. Exemplary hydrazides containing an adsorption promoting moiety include:

1-[4-(2-formylhydrazino)phenyl]-3-methyl thiourea,
3-[4-(2-fornylhydrazino)phenyl-5-(3-methyl-2-benzoxazolinylidene)rhodanine-6-([4-(2-formylhydrazino)phenyl]ureylene)-2-methylbenzothiazole,
N-(benzotriazol-5-yl)-4-(2-formylhydrazino)-phenylacetamide, and
N-(benzotriazol-5-yl)-3-(5-formylhydrazino-2-methoxyphenyl)propionamide and
N-2-(5,5-dimethyl-2-thiomidazol4-yl-idenimino)ethyl-3-[5-(formyl-hydrazino)-2-methoxyphenyl]propionamide.

An especially preferred class of hydrazine compounds for use in the elements of this invention are sulfonamido-substituted hydrazines having one of the following structural formulae:

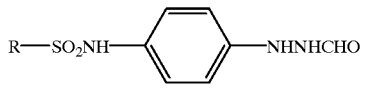

or

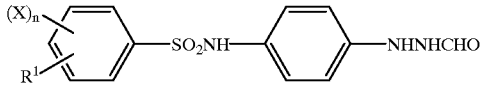

wherein:

R is alkyl having from 6 to 18 carbon atoms or a heterocylic ring having 5 or 6 ring atoms, including ring atoms of sulphur or oxygen;

$R^1$ is alkyl or alkoxy having from 1 to 12 carbon atoms;

X is alkyl, thioalkyl or alkoxy having from 1 to about 5 carbon atoms; halogen; or —$NHCOR^2$, $NHSO_2R^2$, —$CONR^2R^3$ or —$SO_2R^2R^3$ where $R^2$ and $R^3$, which can be the same or different, are hydrogen or alkyl having from 1 to about 4 carbon atoms; and n is 0, 1 or 2.

Alkyl groups represented by R can be straight or branched chain and can be substituted or unsubstituted. Substituents include alkoxy having from 1 to 4 carbon atoms, halogen atoms (e.g. chlorine and fluorine), or —$NHCOR^2$— or —$NHSO_2R^2$— where $R^2$ is as defined above. Preferred R alkyl groups contain from 8 to 16 carbon atoms since alkyl groups of this size impart a greater degree of insolubility to the hydrazine nucleating agents and thereby reduce the tendency of these agents to be leached during development from the layers in which they are coated into developer solutions. Heterocyclic groups represented by R include thienyl and furyl, which groups can be substituted with alkyl having from 1 to 4 carbon atoms or with halogen atoms, such as chlorine.

Alkyl or alkoxy groups represented by $R^1$ can be straight or branched chain and can be substituted or unsubstituted. Substituents on these groups can be alkoxy having from 1 to 4 carbon atoms, halogen atoms (e.g. chlorine or fluorine); or —$NHCOR^2$ or —$NHSO_2R^2$ where $R^2$ is as defined above. Preferred alkyl or alkoxy groups contain from 1 to 5 carbon atoms in order to impart sufficient insolubility to the hydrazine nucleating agents to reduce their tendency to being leached out of the layers in which they are coated by developer solution.

Alkyl, thioalkyl and alkoxy groups which are represented by X contain from 1 to 5 carbon atoms and can be straight or branched chain. When X is halogen, it may be chlorine, fluorine, bromine or iodine. Where more than one X is present, such substituents can be the same or different.

Particularly preferred nucleators are disclosed in European Patent 0 682 288 which are hereby incorporated by reference.

The present materials may also contain a booster compound enabling the desired high contrast when development occurs at a pH below 11.

One class of such boosters are amines which are described in the European Patent referred to above wherein they are defined as an amino compound which:

(1) comprises at least one secondary or tertiary amino group,
(2) contains within its structure a group comprised of at least three repeating ethyleneoxy units, and
(3) has an n-octanol/water partition coefficient (log P) of at least one, preferably at least three, and most preferably at least four, log P being defined by the formula:

$$\log P = \log \frac{[X_{octanol}]}{[X_{water}]}$$

wherein X is the concentration of the amino compound.

Included within the scope of the amino compounds which may be utilised in this invention are monoamines, diamines and polyamines. The amines can be aliphatic amines or they can include aromatic or heterocyclic moieties. Aliphatic, aromatic and heterocyclic groups present in the amines can be substituted or unsubstituted groups. Preferably, the amine boosters are compounds of at least 20 carbon atoms. It is also preferred that the ethyleneoxy units are directly attached to the nitrogen atom of a tertiary amino group.

Preferably the partition coefficient is at least three, most preferably at least 4. Preferred amino compounds for the purposes of this invention are bis-tertiary-amines which have a partition coefficient of at least three and a structure represented by the formula:

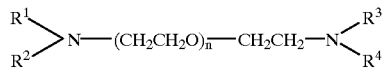

wherein n is an integer with a value of 3 to 50, and more preferably 10 to 50, $R_1$, $R_2$, $R_3$ and $R_4$ are, independently, alkyl groups of 1 to 8 carbon atoms, $R_1$ and $R_2$ taken together represent the atoms necessary to complete a heterocyclic ring, and $R_3$ and $R_4$ taken together represent the atoms necessary to complete a heterocyclic ring.

Another preferred group of amino compounds are bis-secondary amines which have a partition coefficient of at least three and a structure represented by the formula:

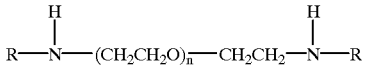

wherein n is an integer with a value of 3 to 50, and more preferably 10 to 50, and each R is, independently, a linear or branched, substituted or unsubstituted, alkyl group of at least 4 carbon atoms.

Particular amine boosters are listed in European Specification 0,364,166. Other types of booster are compounds having one of the formula:

$$Y((X)_n\text{-}A\text{-}B)_m$$

wherein Y is a group which adsorbs to silver halide,

X is a bivalent linking group composed of hydrogen, carbon, nitrogen and sulphur atoms, B is an amino group which may be substituted, an ammonium group or a nitrogen-containing hetercyclic group, m is 1, 2 or 3 and n is 0 or 1, or of the formula:

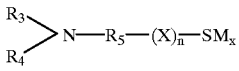

wherein $R_3$ and $R_4$ are each hydrogen or an aliphatic group, or $R_3$ and $R_4$ may together a ring, $R_5$ is a bivalent aliphatic group, X is a bivalent heterocyclic ring having at least one nitrogen, oxygen or sulphur atom as heteroatom, n is 0 or 1, and M is hydrogen or an alkali metal atom alkaline earth metal atom, a quaternary ammonium quaternary phosphonium atom or an amidino group, x is 1 when M is a divalent atom;

said compound optionally being in the form of an addition salt.

The sensitising dye may have one of the general formulae:

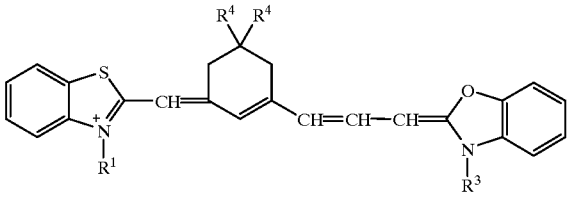

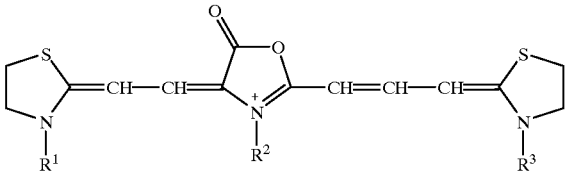

-continued

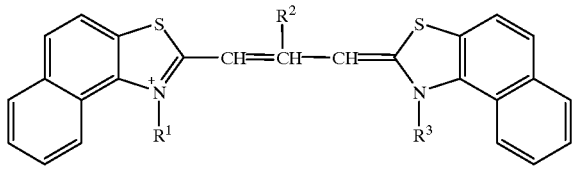

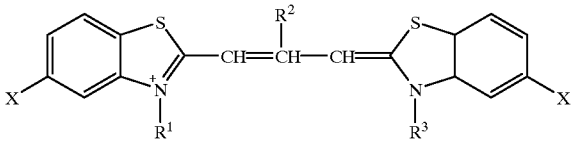

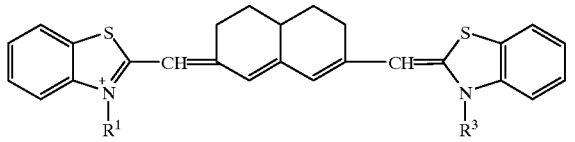

wherein $R^1$, $R^2$ and $R^3$ represent an alkyl group which may be substituted, for example with an acid water-solubilising group, for example a carboxy or sulpho group and R4 is an alkyl group of 1-4 carbon atoms.

X is a halogen, for example chloro, bromo, iodo or fluoro.

The present photographic materials preferably contain an antihalation layer on either side of the support. Preferably it is located on the opposite side of the support from the emulsion layer. In a preferred embodiment an antihalation dye is contained in the hydrophilic colloid underlayer. The dye may also be dissolved or dispersed in the underlayer. Suitable dyes are listed in the Research Disclosure mentioned above.

The light-sensitive silver halide contained in the photographic elements can be processed following exposure to form a visible image by associating the silver halide with an aqueous alkaline medium in the presence of a developing agent contained in the medium or the element. It is a distinct advantage of the embodiment of the present invention which contains a booster that the described photographic elements can be processed in conventional developers as opposed to specialised developers conventionally employed in conjunction with lithographic photographic elements to obtain very high contrast images. When the photographic elements contain incorporated developing agents, the elements can be processed in the presence of an activator, which can be identical to the developer in composition, but otherwise lacking a developing agent. Very high contrast images can be obtained at pH values below 11, preferably in the range of from 10.2 to 10.6, preferably in the range of 10.3 to 10.5, and especially at 10.4.

The developers are typically aqueous solutions, although organic solvents, such as diethylene glycol, can also be included to facilitate the solution of organic components. The developers contain one or a combination of conventional developing agents, such as a polyhydroxybenzene, aminophenol, paraphenylenediamine, ascorbic acid, pyrazolidone, pyrazolone, pyrimidine, dithionite, hydroxylamine or other conventional developing agents. It is preferred to employ hydroquinone and 3-pyrazolidone developing agents in combination. The pH of the developers can be adjusted with alkali metal hydroxides and carbonates, borax and other basic salts. To reduce gelatin swelling during development, compounds such as sodium sulphate can be incorporated into the developer. Chelating and sequestering agents, such as ethylene-diaminetetraacetic acid or its sodium salt, can be present. Generally, any conventional developer composition can be employed in the practice of this invention. Specific illustrative photographic developers are disclosed in the Handbook of Chemistry and Physics, 36th Edition, under the title "Photographic Formulae" at page 3001 et seq. and in Processing Chemicals and Formulas, 6th Edition, published by Eastman Kodak Company (1963). The photographic elements can, of course, be processed with conventional developers for lithographic photographic elements, as illustrated by U.S. Pat. No. 3,573,914 and UK Patent No. 376,600.

The invention is illustrated by the following examples.

EXAMPLE 1

Comparison between a single melt tabular grain coating and dual melt coating with tabular causer (25%) and fine grain (cubic) receiver emulsion. The film coating of this invention consisted of an ESTAR (Registered trade Mark) (polyethylene terephthalate) support (back coated with a pelloid) on which was coated an emulsion layer consisting of two emulsion melts, one of which was spectrally sensitised and tabular in nature, the other not being spectrally sensitised and being cubic (not 111 octahedral in character), an interlayer and a protective supercoat. The supercoat was a standard formula containing matte beads and surfactants and was coated at a gel laydown of 0.5 g/m$^2$.

The interlayer was made up of 0.65 g/m$^2$ gel, 0.2 g/m$^2$ of the copolymer of methyl methacrylate, 2-acryloamido-2-methyl propane sulphonic acid, and the sodium salt of 2-acetoxyethylmethacrylate (88:5:7 by weight), 96 mg/m$^2$ 3,5-disulphocatechol, 85 mg/m$^2$ hydroquinone, 1.8 mg/m$^2$ of nucleator of the following formula

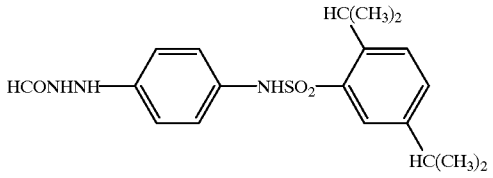

and 75 mg/m$^2$ booster compound of formula;

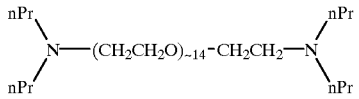

Coating A is not according to the invention and is included for comparative purposes only.

For coating A, the emulsion layer consisted of 2.0 g/m$^2$ of a 100% AgBr 50 nm thin 111 tabular emulsion with mean grain volume of $4.9\times10^{-3}$micrometre$^3$ uniformly doped with ammoniumpentachlororhodate at 0.1 6mg/Agmole and chemically sensitized with thiosulphate and potassium tetrachloroaurate with a 20 minute digestion at 65 degrees centigrade. The emulsion was spectrally sensitised with 160 mg/Agmol naphtho(1,2-d)thiazolium, 1-(3-sulfopropyl)-2-(2-((1-(3-sulfopropyl)naphtho(1,2-d)thiazol-2(1H)-ylidene) methyl)-1-butenyl)-, inner salt, compound, with N,N-diethylethanamine (dye A) and 240 mg/Agmol benzothiazolium, 5-chloro-2-(2-((5-chloro-3-(3-sulfopropyl)-2(3H)-benzothiazolylidene)methyl)-1-butenyl)-3-(3-sulfopropyl)-, inner salt, compound with N,N-diethylethanamine (1:1) (dye B). Other melt addenda included potassium iodide, 2-mercaptomethyl-5-carboxy4-hydroxy-6-methyl-1,3,3a,7-tetraazaindene and 1-(3-acetamidophenyl)-5-mercaptotetrazole. The layer also contained 1.0 g/m$^2$ gel. Dye A is an example of the third structural formula given above and Dye B is an example of the fourth type.

Coating B is according to the invention and was made up as for A except it comprised two emulsion components, the first 0.5 g/m$^2$ of a 100% AgBr 50 nm thin 111 tabular emulsion with mean grain volume of $10.0\times10^{-3}$microm$^3$ and the second at 1.5 g/m$^2$ was a 50:50 chlorobromide cubic monodisperse emulsion (0.1 micrometre edgelength). Both were chemically sensitized with thiosulphate and potassium tetrachloroaurate with a 20 minute digestion at 65 degrees centigrade. Only the 111 tabular emulsion was spectrally sensitised with 160 mg/mol dye A and 240 mg/mol dye B.

All coatings were evaluated by exposure through a 0.1 increment step wedge with a $10^{-6}$s flash sensitometer fitted with a Wratten 29 filter and then processed in Kodak (Registered Trade Mark) RA2000 chemistry (1+2 dilution) at 35° C. for the time specified for each example specifically.

FIG. 1 is a graph showing the DlogE curves obtained for coatings A and B exposed to red light. There is a clear improvement in contrast and speed for the dual melted coating at 20 secong development time, which is considerably over and above any difference that could be ascribed to the size difference between the tabular emulsions. The curves have been normalised to give the same maximum density. The tabular emulsion on its own generates a distinctly lower covering power (silver image) and hence lower maximum density compared to the dual melted coating where the bulk of the density is provided by the fine grain cubic emulsion.

Figure 3:
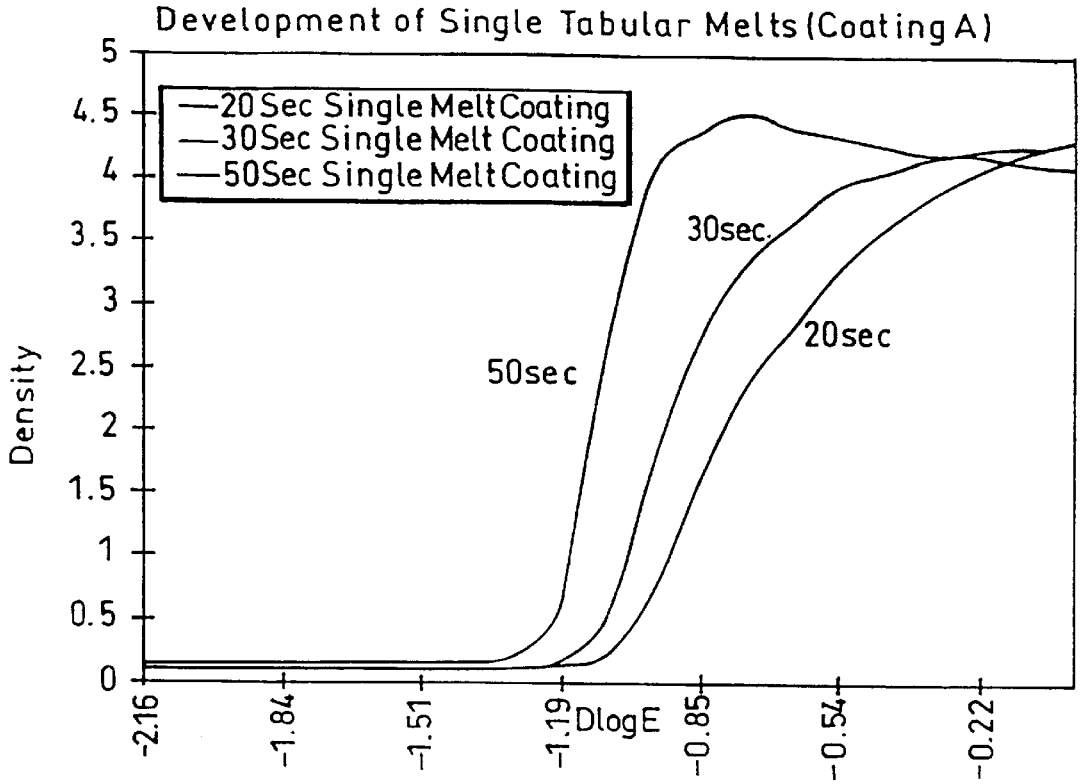
Figure 4:
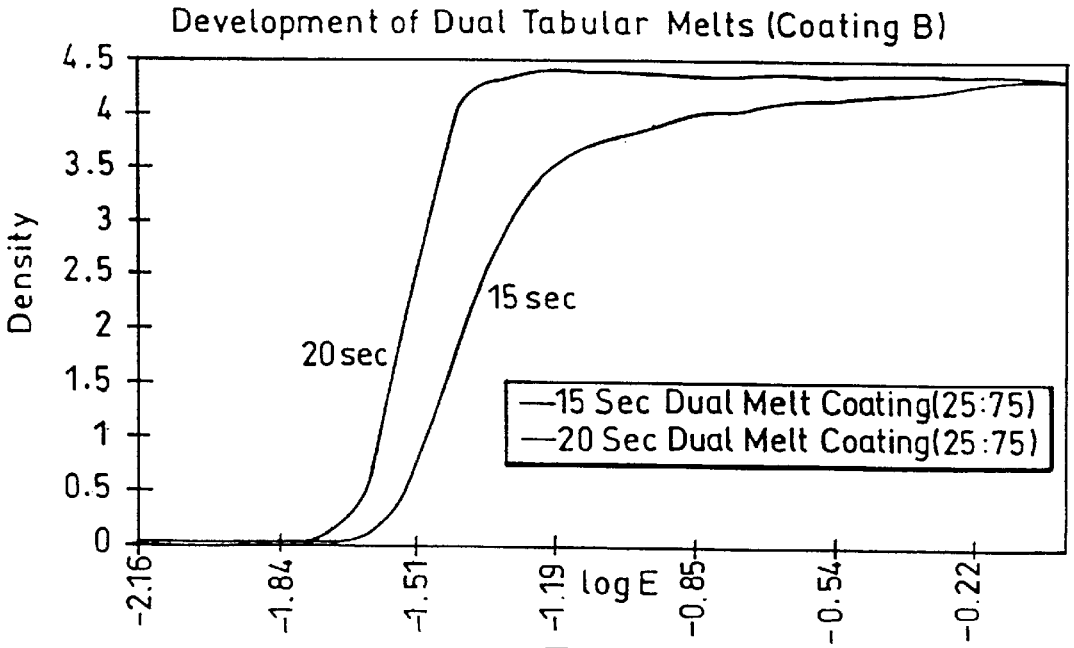

Dual melting the 111 tabular grains with non tabular receivers also shows surprisingly good developability. FIGS. 3 and 4 show development time dependence of coatings A and B at various development times. It is clear that by using dual melting, a substantial development improvement in achieved.

EXAMPLE 2

Improved spectral response of dyes on tabular causer emulsions compared to non tabular In this example a comparison is made between the spectral response of coating B with coating C which is identical to coating B with the exception that it uses a 0.1 micrometre edgelength 50:50 Cl:Br cubic causer emulsion which was chemically sensitized with thiosulphate and potassium tetrachloroaurate with a 20 minute digestion at 65 degrees centigrade and spectrally sensitised with 160 mg/mol dye A and 240 mg/mol dye B.

Coating C is not according to the invention and is included for the purposes of comparison.

Figure 2:
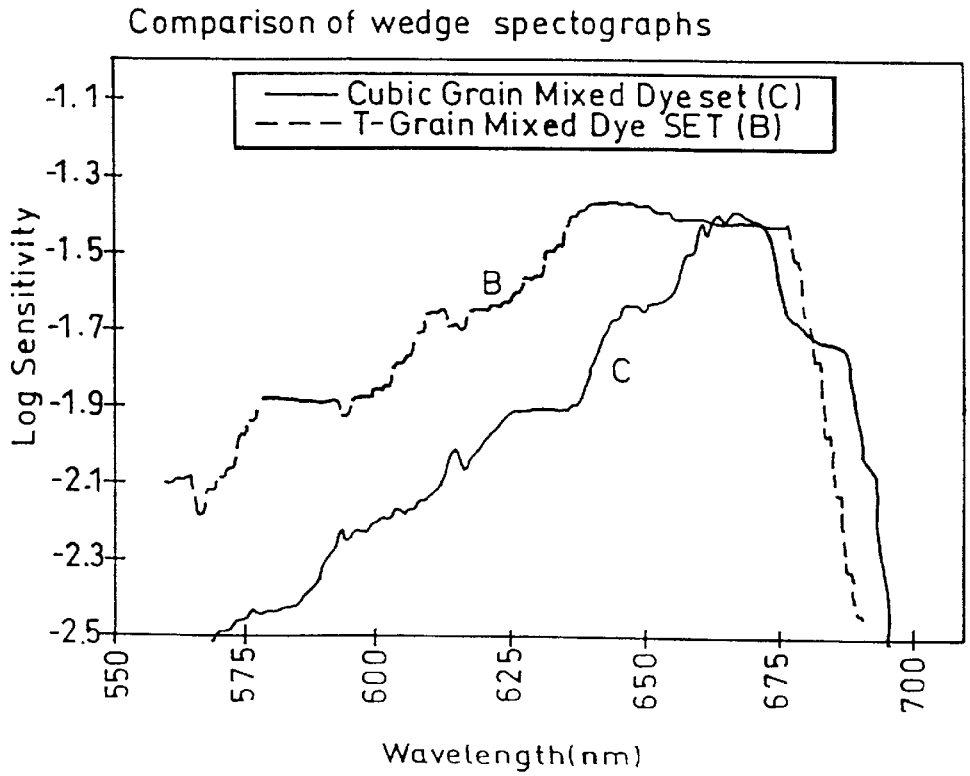

FIG. 2 shows the spectral response of the two coatings. The curves have been normalised to be easily comparable, as the cubic causer emulsion is substantially lower in photographic speed than the tabular causer emulsion.

The photographic materials illustrated in the above examples have the advantageous sensitivity of the 111 tabular emulsions. In addition dyes which are adsorbed to grain surfaces which are of octahedral character have modified absorption properties, compared with the same dyes adsorbed to for instance cubic faces. This is of significance where the absorption characteristic changes yield broader spectral sensitivity, and could be useful for films designed to cater for several exposure devices of differing wavelengths

What is claimed is:

1. A negative-working high contrast photographic material comprising a support bearing a silver halide emulsion layer, containing in the emulsion layer or in an adjacent hydrophilic colloid layer, a hydrazide nucleating agent characterized in that the emulsion layer contains silver halide grains of octahedral character which are spectrally sensitised and silver halide grains which are not octahedral in character.

2. A high contrast photographic material as claimed in claim 1 wherein only the grains which are octahedral in character are spectrally sensitised.

3. A photographic material as claimed in claim 2 which contains in the emulsion layer or an adjacent hydrophilic colloid layer, a booster compound rendering the material developable in a developer solution having a pH below 11.

4. A photographic material as claimed in claim 3 wherein the booster compound is an amine booster.

5. A photographic material as-claimed in claim 2 in which both types of grain are chemically sensitised.

6. A photographic material as claimed in claim 2 in which the spectrally sensitised grains of octahedral character comprise 60 to 100% silver bromide, with the balance of the spectrally sensitised grains being made up of 0 to 40% silver chloride and 0 to 4% silver iodide.

7. A photographic material as claimed in claim 2 wherein the non spectrally sensitised grains comprise 30 to 100% silver chloride.

8. A photographic material as claimed in claim 2 wherein the silver halide grains of octahedral character are doped with one or more Group VIII metals at a level in the range $10^{-9}$ to $10^{-3}$ mole metal per mole of silver.

9. A photographic material as claimed in claim 2 wherein the size of the spectrally sensitised grains ranges from 0.12 to 1.5 micron in equivalent circular diameter, and the size of the non sensitised grains ranges from 0.05 to 1.0 micron in equivalent circular diameter.

10. A photographic material as claimed in claim 2 wherein the aspect ratio of the spectrally sensitised grains is between 4.0 and 50.

11. A photographic material as claimed in claim 10 wherein the aspect ratio of the spectrally sensitised grains is from 6 to 20.

12. A photographic material as claimed in claim 9 wherein the size of the spectrally sensitised grains is from 0.4 to 0.6 micron in equivalent circular diameter.

13. A photographic material as claimed in claim 1 which contains in the emulsion layer or an adjacent hydrophilic colloid layer, a booster compound rendering the material developable in a developer solution having a pH below 11.

14. A photographic material as claimed in claim 13 wherein the booster compound is an amine booster.

15. A photographic material as claimed in claim 1 in which both types of grain are chemically sensitised.

16. A photographic material as claimed in claim 1 in which the spectrally sensitised grains of octahedral character comprise 60 to 100% silver bromide, with the balance of the spectrally sensitised grains being made up of 0 to 40% silver chloride and 0 to 4% silver iodide.

17. A photographic material as claimed in claim 16 wherein the silver halide grains which are not octahedral in character comprise 30 to 100% silver chloride.

18. A photographic material as claimed in claim 1 wherein the silver halide grains of octahedral character are doped with one or more Group VIII metals at a level in the range $10^{-9}$ to $10^{-3}$ mole metal per mole of silver.

19. A photographic material as claimed in claim 1 wherein the size of the spectrally sensitised grains ranges from 0.12 to 1.5 micron in equivalent circular diameter, and the size of the silver halide grains which are not octahedral in character ranges from 0.05 to 1.0 micron in equivalent circular diameter.

20. A photographic material as claimed in claim 1 wherein the aspect ratio of the spectrally sensitised grains is between 4.0 and 50.

* * * * *